United States Patent [19]

Brown et al.

[11] 4,322,875

[45] Apr. 6, 1982

[54] TWO STRIP MATERIALS USED FOR FORMING FASTENERS

[75] Inventors: James N. Brown; Melvin O. Kalleberg, both of St. Paul, Minn.

[73] Assignee: Minnesota Mining and Manfacturing Company, St. Paul, Minn.

[21] Appl. No.: 135,339

[22] Filed: Mar. 31, 1980

[51] Int. Cl.[3] ..... A44B 17/00
[52] U.S. Cl. ..... 24/204
[58] Field of Search ..... 24/204

[56] References Cited

U.S. PATENT DOCUMENTS

| | | | |
|---|---|---|---|
| 2,499,898 | 3/1950 | Anderson | 24/204 |
| 3,266,113 | 8/1966 | Flanagan, Jr. | 24/204 |
| 3,320,649 | 5/1967 | Naimer | 24/204 X |
| 3,408,705 | 11/1968 | Kayser et al. | 24/204 |
| 3,527,001 | 9/1970 | Kleemeier et al. | 24/204 |
| 3,577,607 | 5/1971 | Ikoma | 24/204 |
| 3,708,837 | 1/1973 | Chiba | 24/204 |

FOREIGN PATENT DOCUMENTS

| | | | |
|---|---|---|---|
| 754302 | 1/1971 | Belgium | 24/204 |
| 1232367 | 11/1960 | France | 24/204 |

*Primary Examiner*—Roy D. Frazier
*Assistant Examiner*—Peter A. Aschenbrenner
*Attorney, Agent, or Firm*—Cruzan Alexander; Donald M. Sell; William L. Huebsch

[57] ABSTRACT

Two strip materials from which portions may be severed and used together as a releasably engageable fastener. Each strip material comprises a bonding layer in which are embedded a plurality of U-shaped monofilaments. Each U-shaped monofilament includes two headed stem portions adapted to engage the headed stem portions of the other strip material, and the monofilaments are rectangularly arrayed, and spaced to provide a number of headed stem portions per unit length that are different from and not a multiple of or evenly divisible by the number of headed stem portions per unit length on the other strip material in any direction so that upon engagement the rows of headed stem portions of one strip material cannot readily slip between the rows of headed stem portions on the other.

3 Claims, 3 Drawing Figures

TWO STRIP MATERIALS USED FOR FORMING FASTENERS

BACKGROUND OF THE INVENTION

This invention relates to strip materials that have headed projections which will releasably engage so that two severed portions of the strip materials will provide a releasable fastener between different objects.

U.S. Pat. Application Ser. No. 869,132, now U.S. Pat. No. 4,290,174, describes such a strip material which comprises a flexible polymeric bonding layer; a multiplicity of flexible, resilient, generally U-shaped monofilaments of polymeric material, each including a central bight portion embedded in the bonding layer, two stem portions extending from the bight portion and projecting generally normal to a surface of the bonding layer; and enlarged, generally circular heads at the distal ends of the stem portions. Each of the heads has an outer cam surface adapted for engagement with the cam surfaces of heads along a different portion of the strip material to produce deflection of the stem portions and movement of the heads on the stem portions past each other to releasably engage the portions, and has a latching surface opposite the cam surface, which latching surface is generally planar, extends at generally a right angle radially from its supporting stem portion, and is adapted to engage similar latching surfaces on the heads of the other portion when the portions are engaged.

While fasteners made from two portions cut from the strip material described in U.S. Pat. Application Ser. No. 869,132 have provided many advantages over other known fasteners for many applications, problems have been encountered when those portions are engaged with their rows of headed projections aligned, and when forces are subsequently applied to the two fastener portions in a direction parallel to their backing layers and aligned with the rows. Under these conditions, the rows of headed projections on one portion can slide between the rows of headed projections on the other portion, and allow the portions to become partially or totally disengaged. U.S. Pat. Application Ser. No. 869,132 teaches reducing this problem by (1) varying the spacings of the stems along the rows extending longitudinally of the strip so that at least when the rows of two articles with such varied spacing are engaged at right angles to each other, greater separating and shear strengths will be developed, or (2) disposing the rows of U-shaped filaments so that their stems are not aligned normal to or parallel with the edges of the strip so that when a user engages two articles made from the strip with their edges aligned (as he would normally be expected to do), the rows on the articles will cross each other to develop the maximum strength in the fastener both in tension and shear, or (3) shifting successive rows of U-shaped filaments slightly in a direction transverse to the strip so that the stems of successive rows will not be aligned and thus will not permit shearing longitudinally to the strip.

While these techniques would help reduce the problem, they do not preclude slippage between the rows for all possible orientations of the rows. Additionally, the mechanism for accomplishing the second and particularly the third techniques mentioned complicate the device on which the strip material is produced moe than might otherwise be desired.

SUMMARY OF THE INVENTION

According to the present invention there are provided two different strip materials each generally of the type described above, a portion of each of which when used together will form a fastener that when engaged will restrict slippage when forces are applied in a direction parallel to the backing layers of the portions regardless of the orientation in which the portions are attached together.

The strip materials, like the strip material described in U.S. Pat. Application Ser. No. 869,132, each comprise a polymeric bonding layer; a multiplicity of flexible, resilient, generally U-shaped monofilaments each including a central bight portion embedded in the bonding layer and two stem portions extending from the opposite ends of the bight portion and projecting generally normal to an exposed major surface of the bonding layer; and enlarged, generally circular heads at the ends of the stem portions opposite the bight portion, each of the heads having a cam surface opposite its supporting stem portion, and having a latching surface opposite the cam surface; the bight portions of the U-shaped monofilaments being disposed in a rectangular array.

Unlike that strip material which was designed to engage with itself, however, the present invention utilizes two such strip materials, each of which has stem portions that are about equally spaced in each direction to provide numbers of stem portions per unit length along the surface of its bonding layer in each direction that are different from and not a multiple of or evenly divisible by the number of stem portions per unit length on the other strip material in either direction (e.g., 20 stem portions per inch in each direction on one strip material, and 12 stem portions per inch in one direction and 14 stem portions per inch in the other direction on the other strip material). With this construction, when portions of the two strip materials are engaged with rows aligned, certain of the stem portions will always interfere with each other to prevent relative movement between the portions of the strip materials in a direction parallel to their bonding layers.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
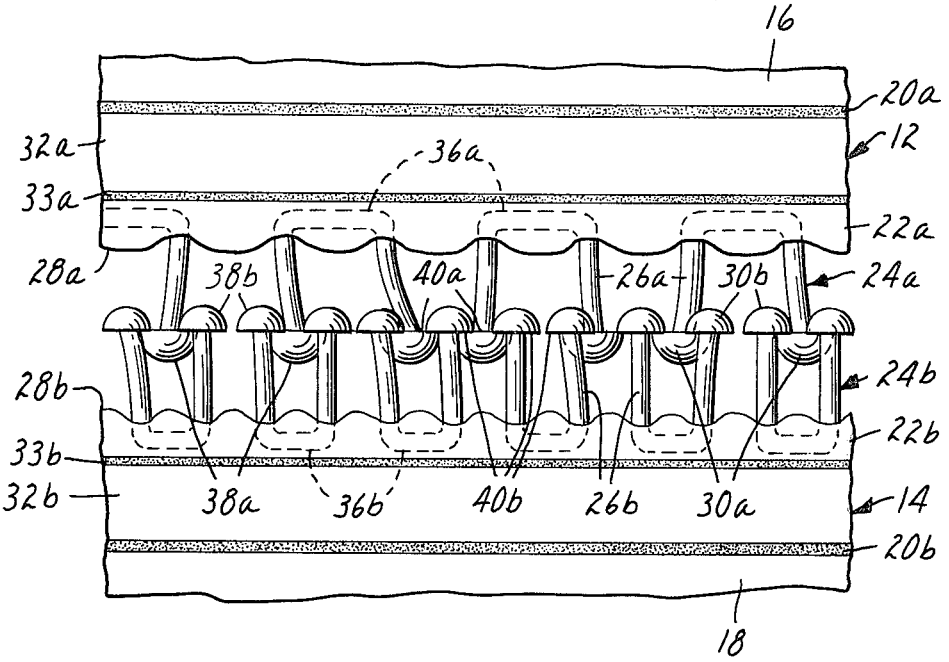
FIG. 1 is a fragmentary edge view of two strip materials according to the present invention shown engaged with each other.

Referring now to the drawing there are shown portions severed from two different elongate strip materials 12 and 14 according to the present invention, which portions of the strip materials 12 and 14 may then be attached to the surfaces of different objects 16 and 18 via layers of pressure sensitive adhesive 20*a* and 20*b* and engaged with each other as illustrated in FIG. 1 to fasten the objects 16 and 18 together.

Generally the strip materials 12 and 14 from which the portions are severed have identical structures except for the spacing of stem portions thereof, and thus the same reference numerals will be used in describing them, with the suffix "a" being used to identify the strip material 12 and the suffix "b" being used to identify the strip material 14.

The strip materials 12 and 14 each comprise a bonding layer 22*a* or 22*b* in which are embedded a plurality of flexible, resilient, generally U-shaped monofilaments 24*a* or 24*b*. The monofilaments 24*a* or 24*b* have stem portions 26*a* or 26*b* that project from a major surface 28*a* or 28*b* of the bonding layer 22*a* or 22*b* and have heads 30*a* or 30*b* at their distal ends. The bonding layer 22*a* or 22*b* and the method by which the monofilaments 24*a* or 24*b* are embedded in the bonding layer 22*a* or 22*b* are described in greater detail in U.S. Pat. Application Ser. No. 869,132, the content whereof is incorporated herein by reference. Also, the strip materials 12 and 14 each include a layer of low density foam 32*a* or 32*b* and the layer of pressure-sensitive adhesive 20*a* or 20*b* which is a soft tacky pressure-sensitive adhesive, which layers 32*a*, 32*b*, 20*a* and 20*b* help in securely attaching the strip material 12 or 14 to an object as in described in greater detail in U.S. Pat. Application Ser. No. 31,973, now U.S Pat. No. 4,216,257, the content whereof is also incorporated herein by reference. The layer of foam 32*a* or 32*b* is adhered to the surface of the bonding layer 22*a* or 22*b* opposite the surface 28*a* or 28*b* by a layer of adhesive 33*a* or 33*b* which may be of the same material as the layer of adhesive 20*a* or 20*b*.

The bonding layer 22*a* or 22*b* in which the U-shaped monofilaments 24*a* or 24*b* are embedded is of a uniform nonfibrous, nonoriented polymeric material which has a predetermined thickness adapted to receive bight portions 36*a* or 36*b* of the U-shaped monofilaments 24*a* or 24*b*. The U-shaped monofilaments are formed of a longitudinally-oriented polymeric material. The stem portions 26*a* or 26*b* of each monofilament 24*a* or 24*b* are of essentially the same length, project at generally a right angle from the surface 28*a* or 28*b* of the bonding layer 22*a* or 22*b* and extend from the ends of the embedded bight portion 36*a* or 36*b* of the monofilament 24*a* or 24*b*. The heads 30*a* or 30*b* have arcuate, generally semi-spherical cam surfaces 38*a* or 38*b* opposite the bonding layer 22*a* or 22*b*, so that the cam surfaces 38*a* of the heads 30*a* on the portion severed from the strip material 12 are adapted for engagement with the cam surfaces 38*b* on the heads of 30*b* of the portion severed from the strip material 14 to produce the necessary side deflection of the stem portions 26*a* and 26*b* upon movement of the heads 30*a* or 30*b* toward each other with the bonding layers 22*a* and 22*b* generally parallel so that the heads 30*a* and 30*b* may pass to engage the strip materials 12 and 14 in the manner illustrated in FIG. 1. Also, the heads 30*a* or 30*b* on each strip material 12 or 14 each have a generally planer latching surface 40*a* or 40*b* extending radially outwardly of its supporting stem portion 26*a* or 26*b*, which latching surface 40*a* or 40*b* is adapted to engage the latching surface 40*a* or 40*b* on one or more of the heads 30*a* or 30*b* of the other strip material 12 or 14 to retain the heads 30*a* or 30*b* in engagement until a predetermined force is applied to separate them.

The monofilaments 24*a* or 24*b* are bonded in the bonding layer 22*a* or 22*b* with their bight portions 36*a* or 36*b* in a rectangular array and parallel to each other and to parallel edges 42*a* or 42*b* of the bonding layer 22*a* or 22*b*. The bight portions 36*a* or 36*b* of groups of the monofilaments 24*a* or 24*b* are disposed side by side to form a series of generally parallel rows, with each row of monofilaments 24*a* or 24*b* providing two corresponding rows of aligned stem portions 26*a* or 26*b* and heads 30*a* or 30*b* which are disposed generally normal to the edges 42*a* or 42*b*. The stem portions 26*a* or 26*b* on each U-shaped monofilament 24*a* or 24*b* and the adjacent stem portions 26*a* or 26*b* of adjacent U-shaped monofilaments 24*a* or 24*b* along the rows (i.e., in directions both parallel to and at right angles to the length of the bight portions 36*a* or 36*b*) are about equally spaced apart in both directions on the strip material 12 or 14. The heads 30*b* on the strip material 14 are spaced apart in both directions so that the head 30*a* of a monofilament 24*a* on the strip material 12 may be positioned therebetween without substantially spreading the stem portions 26*b*. The heads 30*b* on these adjacent stem portions 26*b*, however, are spaced apart a distance less than the diameter of the heads 30*a*, however, so that the heads 30*a* on the strip material 12 may only move therebetween upon separation of the heads 30*b* by resilient deflection of the stem portions 26*b*. This spacing is experimentally determined so that it is sufficient to afford movement of the heads 30*a* and 30*b* on each of the strip materials 12 and 14 past each other with the bonding layers 22*a* or 22*b* of the strip materials 12 and 14 maintained generally parallel to each other and with the rows of U-shaped monofilaments 24*a* or 24*b* in any relative angular orientation. This spacing, however, is generally not much greater than that required for such engagement so as to provide the maximum disengagement force for the heads 30*a* or 30*b* on the fastener portions 12 and 14.

Figure 2:
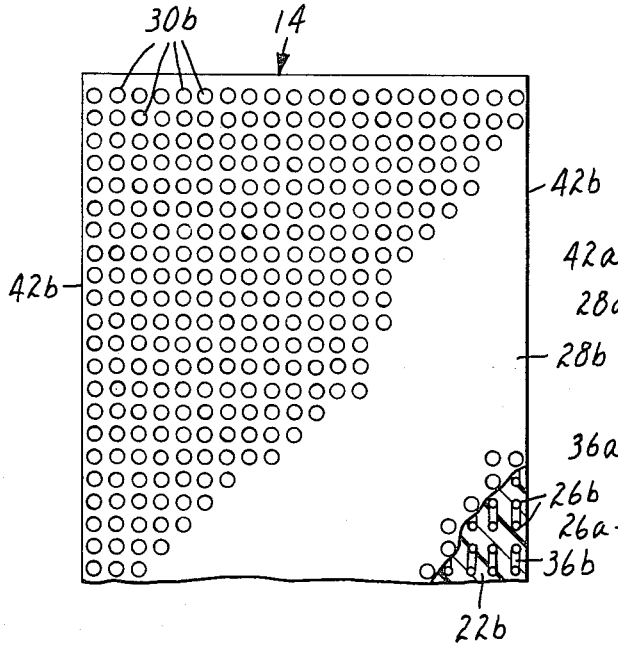
FIG. 2 is a fragmentary reduced top plan view, partially in section of the bottom strip material shown in FIG. 1.
Figure 3:
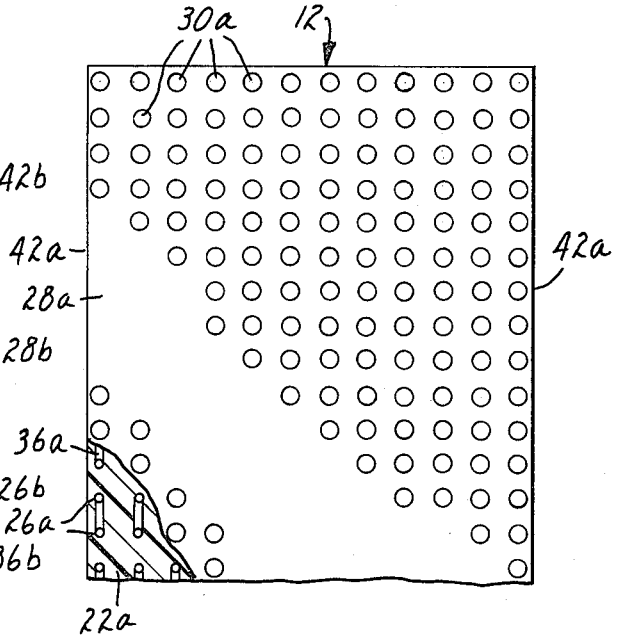
FIG. 3 is a fragmentary reduced top plan view, partially in section of the top strip material shown in FIG. 1.

As is best seen in FIGS. 2 and 3, the stem portions 26*a* or 26*b* on each strip material 12 or 14 are almost equally spaced in each direction (i.e., normal to and parallel to the edges 42*a* or 42*b* of the strip materials) to provide numbers of stem portions 26*a* or 26*b* per unit length that are different from and not a multiple of or evenly divisible by the number of stem portions 26*a* or 26*b* per unit length on the other strip material 12 or 14 in either direction. This assures that when portions of the strip materials 12 and 14 are engaged with each other with their rows aligned, certain of the stem portions 26*a* and 26*b* will always interfere with each other to prevent relative movement between the portions in directions parallel to their bonding layers 22*a* and 22*b*.

As a specific nonlimiting example, when the strip material 14 has stem portions 26*b* 0.015 inch (0.381 mm) in diameter and projecting 0.049 inch (1.225 mm) and heads 30*b* 0.032 inch (0.813 mm) in diameter, and has 20 generally equally spaced stem portions 24*b* per inch in both directions; and the strip material 12 has the same diameter stem portions 26*a* projecting 0.040 inch (1.016 mm) and heads 30*a* 0.035 inch (0.889 mm) in diameter, and has 12 equally spaced stem portions 24*a* per inch in one direction and 14 equally spaced stem portions 24*a* per inch in the other; portions of the strip materials 12 and 14 will securely mate with each other and will not slip in directions parallel with their bonding layers 22*a* and 22*b*. When the strip material 12 has 13 such equally spaced stem portions 24*a* per inch in one direction and 14 such equally spaced stem portions 24*a* per inch in the other it will also engage very securely and would not slip on the strip material 14 described in this paragraph, but repeated engagement and disengagement will deform the stem portions 26*a* and 26*b*, showing excessive interference therebetween. Generally, when the strip material 12 has less than 15 such equally spaced stem portions 26*a* per inch in each direction it will mate acceptably with the strip portion 14 described in this paragraph, however the first strip material 12 described in this paragraph is preferred if numerous engagements and disengagements are anticipated.

We claim:

1. Two strip materials from which lengths may be severed to form portions of a fastener, said strip materials each having a known structure comprising a polymeric bonding layer; and a multiplicity of flexible, resilient, generally U-shaped monofilaments, each monofilament including a central bight portion embedded in the bonding layer, two stem portions extending from the opposire ends of said bight portion and projecting generally normal to an exposed major surface of the bonding layer, and enlarged, generally circular heads at the ends of said stem portions opposite said bight portion, each of the heads having a cam surface opposite its supporting stem portion adapted for engagement with the cam surfaces of heads along the other strip material to produce deflection of the stem portions and to afford movement of the heads on the stem portions past each other, and having a latching surface opposite said cam surface adapted to engage a similar latching surface on another head; the bight portions of said U-shaped monofilaments on each strip material being disposed in a rectangular array and spaced to afford movement of the heads of the strip materials past and into releasable engagement with each other, said strip materials being improved to restrict relative movement between the engaged portions in directions parallel to said bonding layers in that the stem portions on each of the strip materials are about equally spaced in each direction to provide numbers of stem portions per unit length on one strip material that are different from and not a multiple of or evenly divisible by the number of stem portions per unit length on the other strip material in either direction so that when portions of the strip materials are engaged with the rows aligned, certain of the stem portions will always interfere with each other to restrict said relative movement between the portions of the strip materials.

2. Two strips materials according to claim 1 wherein there are 20 stem portions per inch in each direction on one strip material, and 12 stem portions per inch in one direction and 14 stem portions per inch in the other direction on the other strip material.

3. Two strip materials according to claim 1 wherein there are about 20 stem portions per inch in each direction on one strip material, and less than 15 stem portions per inch in each direction on the other strip material.

* * * * *